US005498075A

United States Patent [19]

Jarchau et al.

[11] Patent Number: 5,498,075

[45] Date of Patent: Mar. 12, 1996

[54] PREMIX HOMOGENIZING SYSTEM

[75] Inventors: Michael Jarchau; Steffen Jahnke, both of Lubeck, Germany

[73] Assignee: APV Gaulin GmbH, Lubeck, Germany

[21] Appl. No.: 226,196

[22] Filed: Apr. 11, 1994

[51] Int. Cl.[6] ..... B01F 5/06

[52] U.S. Cl. ..... 366/176.2; 137/512; 137/613

[58] Field of Search ..... 366/176, 176.1, 366/176.2; 99/452; 137/512, 613

[56] References Cited

U.S. PATENT DOCUMENTS

| | | | |
|---|---|---|---|
| 1,690,799 | 11/1928 | Snow . | |
| 2,435,884 | 2/1948 | Galewski | 366/176.1 |
| 2,817,500 | 12/1957 | Robinson | 366/176 |
| 2,901,981 | 9/1959 | Wakeman | 366/176 |
| 3,737,148 | 6/1973 | Phillips | 366/176 |
| 4,585,357 | 4/1986 | Ogata | 366/176 |
| 4,952,067 | 8/1990 | Dallas | 99/452 |

OTHER PUBLICATIONS

Diagram of a Three Stage Valve Assembly, Gaulin Corporation (no date).

Karbstein, et al., "Emulgiertechnik," Karlsruhe University, Mar. 1994, pp. 11–1–11–33, 1–X–37 w/partial translation.

Mack, M. J., "Controlling Physical Properties of High Solids Mixes," *Journal of Dairy Science*, vol. 17, No. 12, 1934, pp. 781–789.

Frandsen, J. H., and Nelson, D. H., *Ice Creams and Other Frozen Desserts*, Published by J. H. Frandsen, Amherst, Massachusetts, 1950, p. 147.

Sommer, Hugo H., *The Theory and Practice of Ice Cream Making*, Published by the author, Madison, Wisconsin, 1938, p. 126.

*Primary Examiner*—Robert W. Jenkins

*Attorney, Agent, or Firm*—Hamilton, Brook, Smith & Reynolds

[57] ABSTRACT

Homogenizing pressures are reduced by providing three homogenizing valves in series. The addition of a holding chamber between the first and second stages which provides a dwell time in the order of seconds can further reduce the pressure requirements or improve product quality for a given pressure.

26 Claims, 7 Drawing Sheets

PREMIX HOMOGENIZING SYSTEM

BACKGROUND

Homogenization is the breaking down and mixing of the components of an emulsion or dispersion. A major use of homogenizers is to break down and disperse milk fat into the bulk of skim milk. This delays creaming of milk fat globules. Homogenizers are also used to process other emulsions such as silicone oil and to process dispersions such as pigments, antacids, and various paper coatings.

In the most widely used type of homogenizer, the emulsion is introduced at high pressure of from 500 psi to 10,000 psi (34.5 to 689.5 bar) to a central bore within an annular valve seat. The emulsion is forced out through a narrow gap between the valve seat and a valve member. Through the gap, the emulsion undergoes extremely rapid acceleration as well as an extreme drop in pressure. This violent action through the valve breaks down globules within the emulsion to produce the homogenized product.

The degree of homogenization is a function of the difference between the pressure of the emulsion at the inlet to the valve and the pressure at the outlet. Past systems for homogenizing milk have, for example, used an inlet pressure in the order of 2,000 psi (137.9 bar). To improve the final product, two stage systems have been used. In such systems, liquid from a high pressure pump delivers liquid to the gap of a first homogenizing valve, and the liquid which is thus homogenized is directed to a second valve through which the liquid is expressed for further homogenization. The total pressure of the system is the sum of the pressure drops across the two valves.

Recently, in an effort to reduce the amount of energy required to homogenize milk and other products to a predetermined degree, attempts have been made to decrease the required homogenizing pressure.

SUMMARY OF THE INVENTION

It has been determined that by providing a third stage homogenizing valve, with its attendant pressure drop, the overall pressure required for a given quality of homogenized product may be reduced by 20% or more. That reduction in pressure results in a reduction in power requirements. Thus, a 160 bar three stage homogenizer operating, for example, at pressure drops of 40, 100 and 20 bar respectively, may result in droplet sizes in the homogenized product similar to those in a 190 bar two stage homogenizer operating at pressure drops of 170 and 20 bar respectively.

It has also been determined that providing a holding time between the first (premixing) stage and the next stage can reduce the overall pressure requirements by about 5% for a given quality of product.

Thus, in accordance with the present invention, a homogenizing system comprises a high pressure pump with a principle flow path of liquid from the pump flowing through first, second and third homogenizing valves connected in series. Preferably, a holding chamber is provided between the first and second stages. Preferred dwell times in the holding chamber are from 0.5 to 5 seconds, and most preferably between 0.8 and 2 seconds. Preferred ranges in pressure drops across the three stages are 20–200, 50–1,000 and 20–200 bar for the first, second and third stages, respectively. Most preferred pressure ranges are 20–100, 50–700 and 20–70 bar, respectively.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
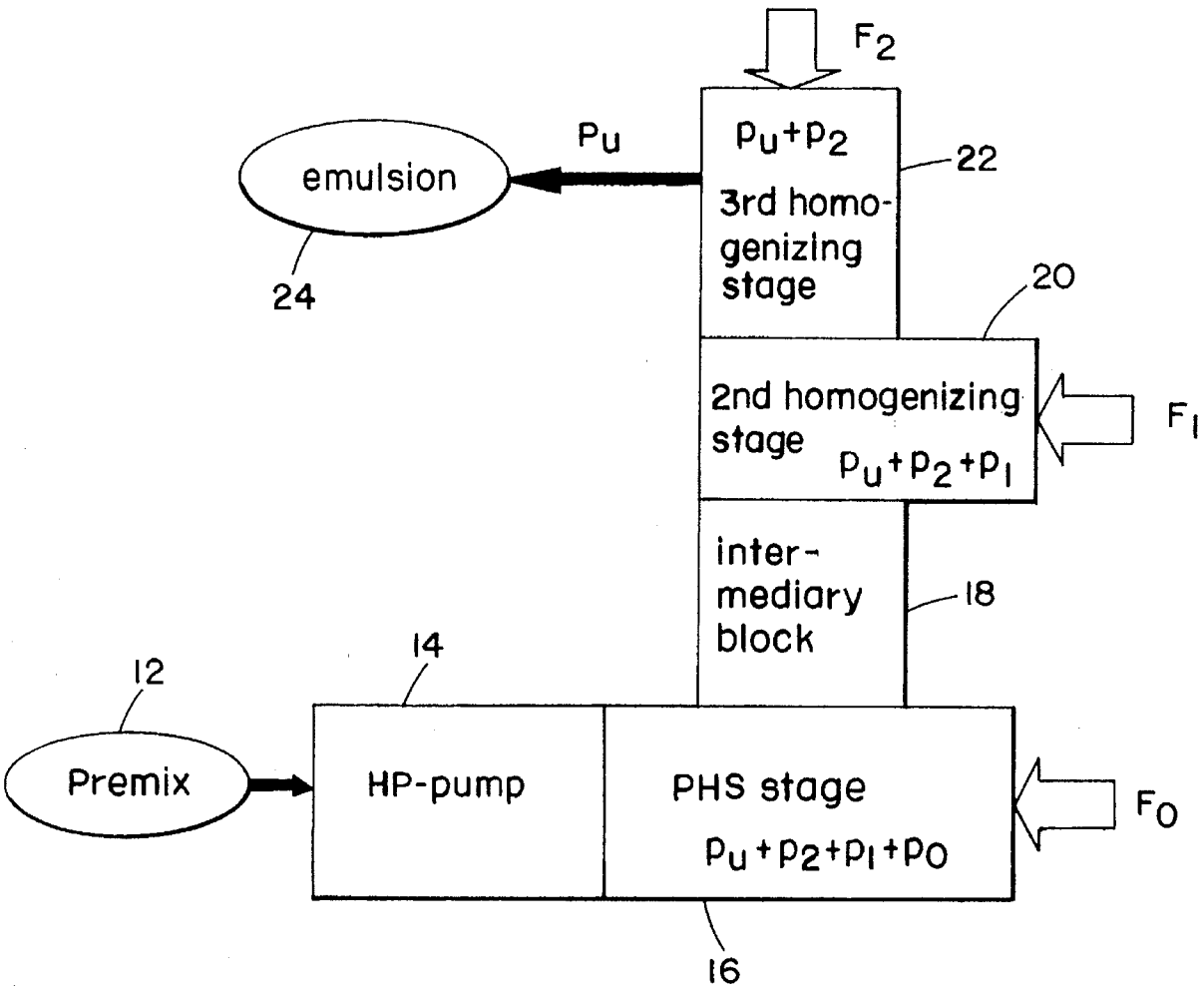
FIG. 1 is a schematic illustration of a homogenizing system embodying the present invention.

FIG. 1 illustrates a system embodying the present invention, the solution to be homogenized is drawn from a tank 12 which may be a conventional premixing tank. The liquid is forced through the system at a constant flow rate by a high pressure pump 14. The liquid is initially delivered to a first stage homogenizing valve 16 which causes an adjustable pressure drop in the liquid improving the premix. The thus premixed liquid is delivered through an optional intermediate holding line block 18 to a second stage homogenizing valve 20 which also has an adjustable pressure drop. Finally, the liquid is delivered through a third homogenizing stage 22 for further homogenization and final delivery to an emulsion tank 24.

The input pressures to each of the stages are indicated in the stages. Accordingly, it can be seen that the premixing stage 16 has a pressure drop of $p_0$, the second stage 20 has a pressure drop of $p_1$ and the final stage 22 has a pressure drop of $p_2$. $P_u$ is the discharge pressure to transfer finished emulsion to tank 24.

Figure 2:
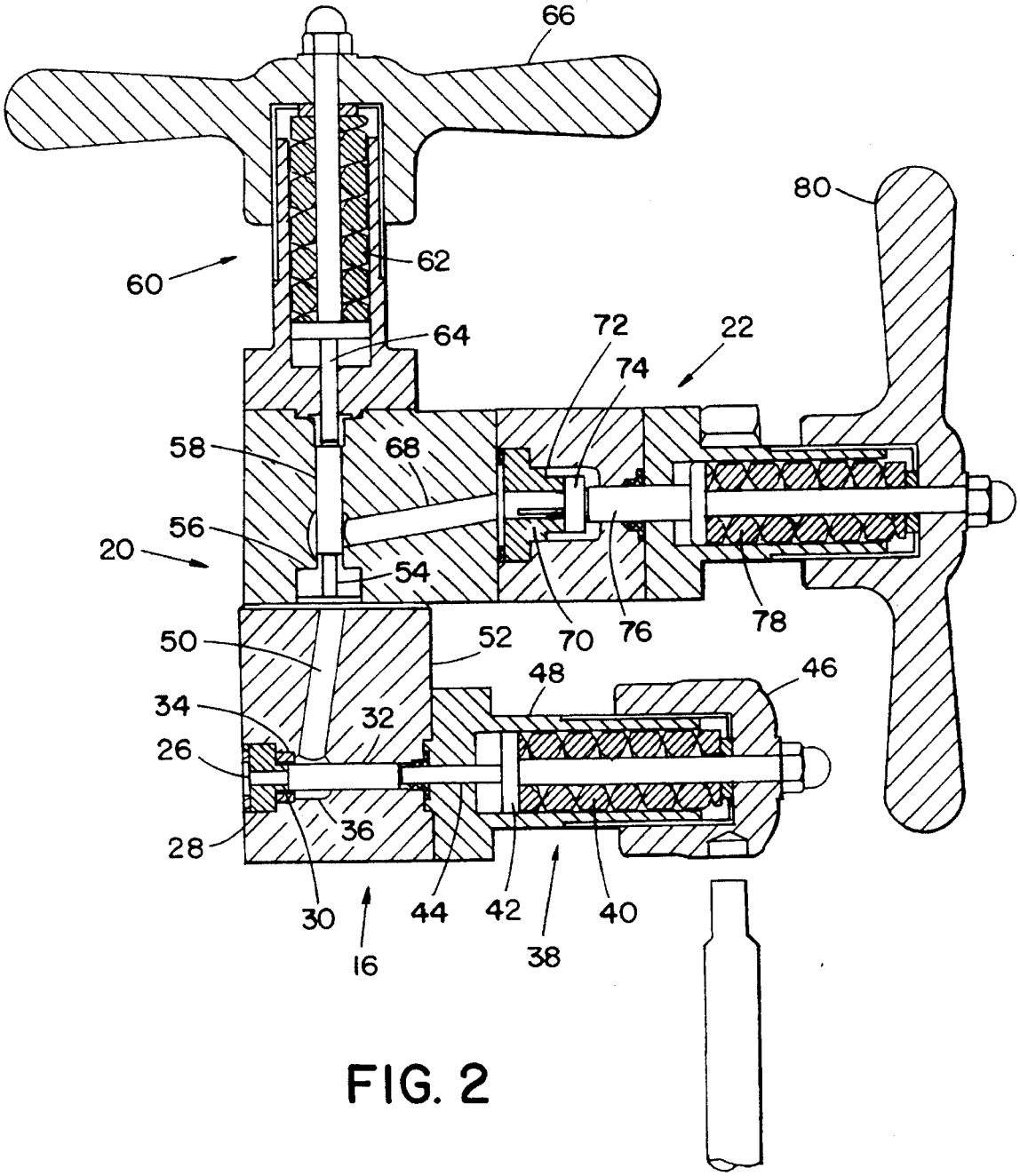
FIG. 2 is a cross-sectional view of the homogenizing valves in one embodiment of the present invention.

FIG. 2 illustrates three homogenizing stages connected in series. Each stage is an APV Gaulin Lab 60-10TBS homogenizing valve. High pressure liquid is received from the high pressure pump 14 (not shown in FIG. 2) at the inlet 26 of a valve seat 28. The liquid is expressed radially through a slit 30 between the valve seat and a valve member 32. A liquid is expressed against an impact ring 34 and flows into an annulus 36. The valve member 32 is retained against the pressure of the inlet flow, to establish the back pressure in line 26, by an actuator 38. In this illustration, the actuator is spring loaded, but hydraulic or pneumatic systems are more likely in large scale systems. In this case, the back pressure is established by a spring 40 which is held in compression between a shoulder 42 on the actuating rod 44 and a retainer cap 46. The cap 46 is threaded onto the actuator housing 48 to establish the spring compression and thus the back pressure.

The premixed liquid flows from the annulus 36 through a line 50 in the homogenizer block 52. In the lab 60-10 TBS system with its volume flow of 60 liters per hour, the line 50 provides a dwell time of 246.8 milliseconds.

The liquid from line 50 is introduced into the port 54 in the valve seat 56 of the second homogenizing stage 20. The liquid is homogenized as it is expressed radially through the gap between the valve seat 56 and the valve member 58. The actuator 60 of the second stage similarly has a spring 62 which presses a actuating rod 64 against the valve member 58. In this case, the actuator is shown to include an adjustment wheel 66 for adjusting the compression of the spring 62 and thus the back pressure provided by the second stage 20. Again, a hydraulic or pneumatic system would be preferred in a large scale system.

Finally, the liquid from the second stage flows through a line 68 and is delivered to the third homogenizing stage 22. Again, the liquid enters a port 70 in a valve seat 72 and is expressed through a gap between the valve seat 72 and a valve member 74. The valve member 74 is retained against the flow to establish a back pressure by an actuating rod 76 driven by a compression spring 78 or a hydraulic or pneumatic system. The compression of the spring 78 is adjustable by a wheel 80.

Figure 3:
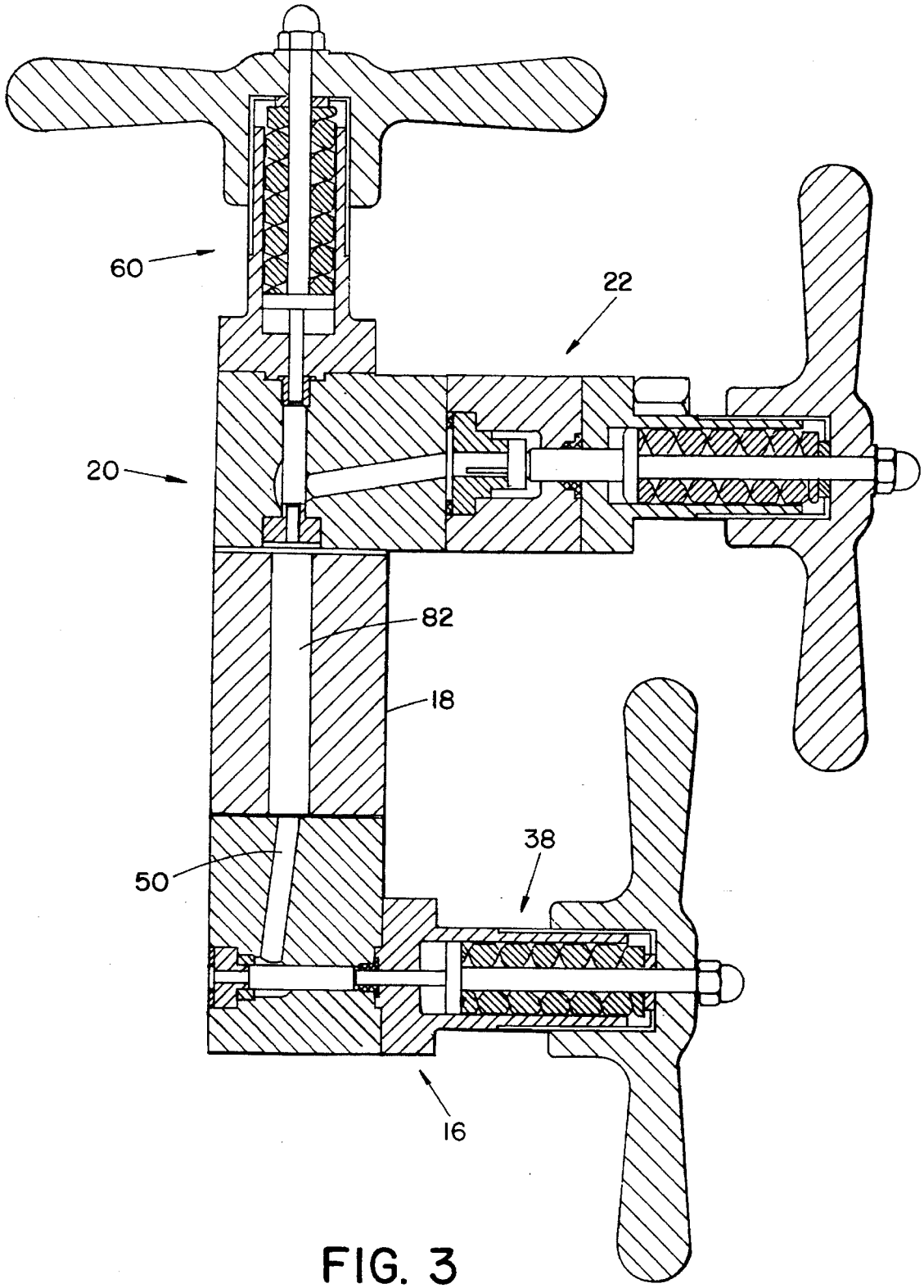
FIG. 3 is a cross-sectional view of the homogenizing valves with an additional holding chamber in accordance with a preferred embodiment of the invention.

FIG. 3 illustrates an improvement to the system of FIG. 2. In this system, dwell time is provided between the first and second stages by a holding chamber 82 in the intermediate block 18. The combined residence time of the line 50 and the holding chamber 82 for the system presented here is 815.5 milliseconds. The holding time between the premixing stage and the second stage causes the emulsion to dwell for a time which is long enough to allow the emulsifier to stabilize the newly generated surfaces yet is short enough to prevent coalescence and agglomeration.

Figure 4:
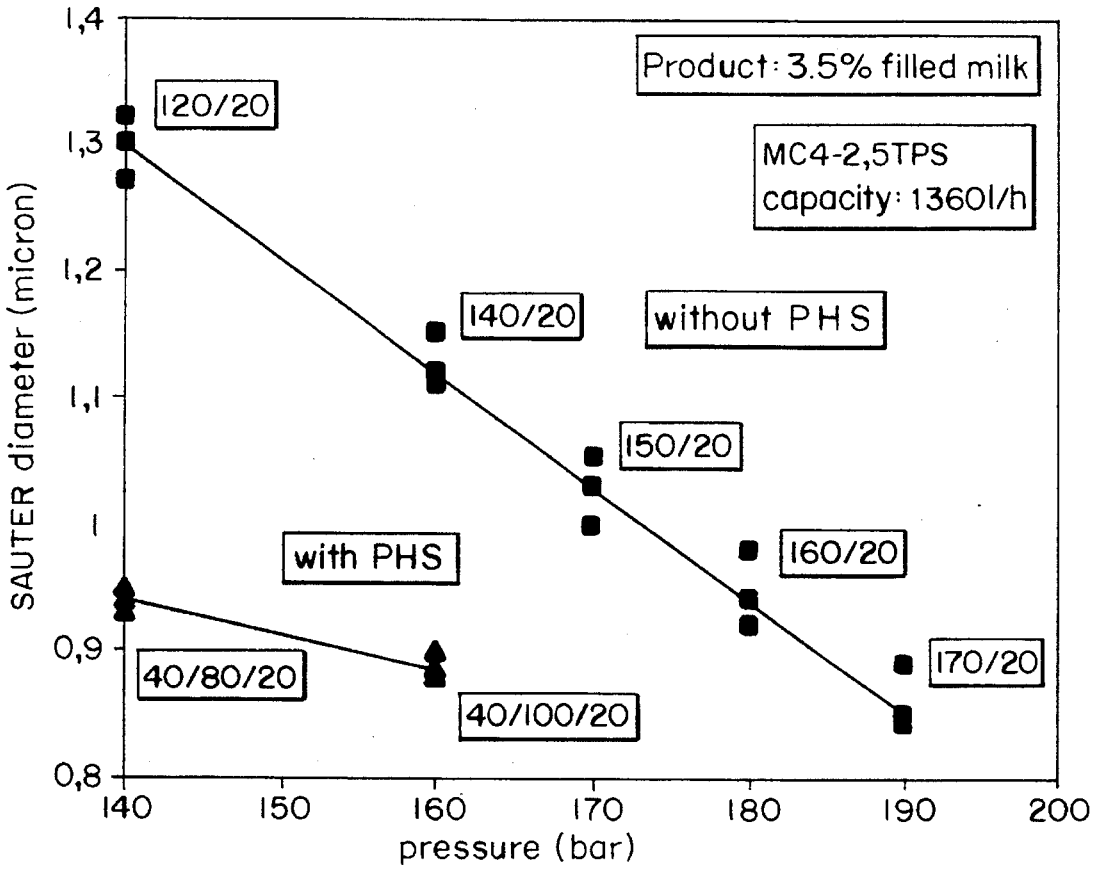
FIG. 4 illustrates the reduction in pressure requirements utilizing the premixing homogenizing stage of the present invention.

FIG. 4 illustrates how the product quality can be maintained with reduced inlet pressures using the premixing homogenizing stage (PHS) of the present invention. These tests were conducted using APV Gaulin MC4-2,5TPS homogenizer. The pressure drops of respective first, second and third stages are indicated adjacent to the data points. It can be seen that a SAUTER diameter of less than 0.9 requires a total pressure of nearly 190 bar in a typical two stage system, but that such a diameter can be obtained with only 160 bar in the three stage system. Even though the additional stage requires an incremental pressure drop, the combined pressure drop of the three stages can be substantially less than that of the two stage system.

Figure 5:
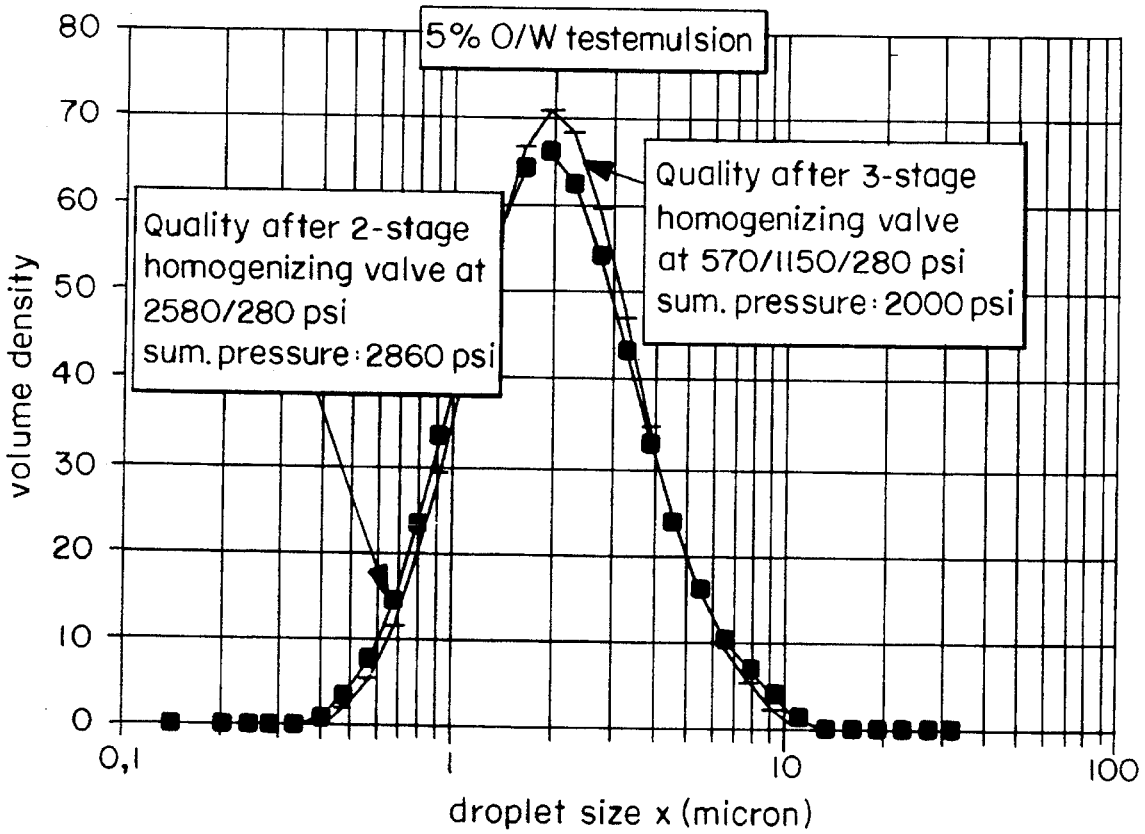
FIG. 5 illustrates similar quality of product with substantially reduced total pressure utilizing the present invention.

FIG. 5 illustrates that comparable droplet size profiles can be obtained using a substantially reduced inlet pressure with three stages. Specifically, a two stage system with pressure drops of 2580 and 280 psi (177.9 and 19.3 bar) for a total of 2860 psi (197.2 bar) provides similar results to a three stage 2000 psi (137.9 bar) system with pressure drops of 570, 1150 and 280 psi (39.3, 79.3 and 19.3 bar), respectively. Thus, the three stage system allows a 30% reduction in pressure and a corresponding reduction in power requirements.

Figure 6:
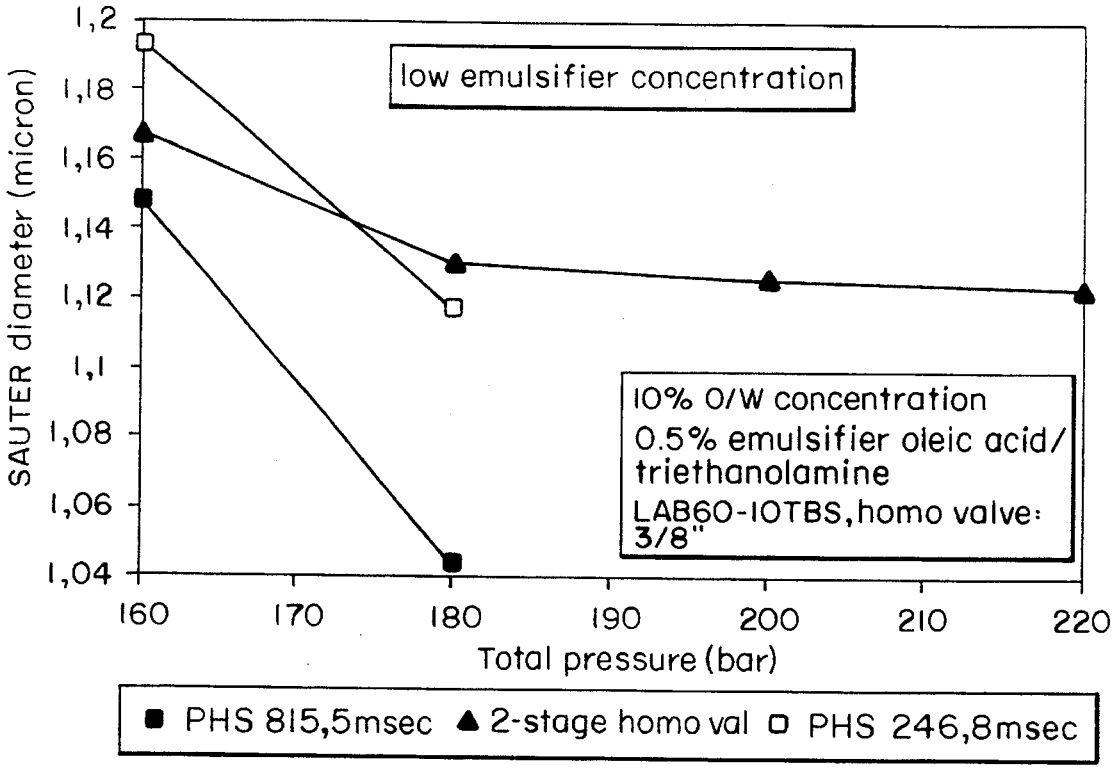
FIG. 6 illustrates improvement in product quality with the additional holding chamber of FIG. 3.

FIG. 6 illustrates the influence of the additional holding time. It can be seen that at 180 bar total pressure, the three stage system without the additional holding chamber provides an improved product quality; whereas, the three stage system with the holding chamber results in a substantial improvement in product quality.

Figure 7:
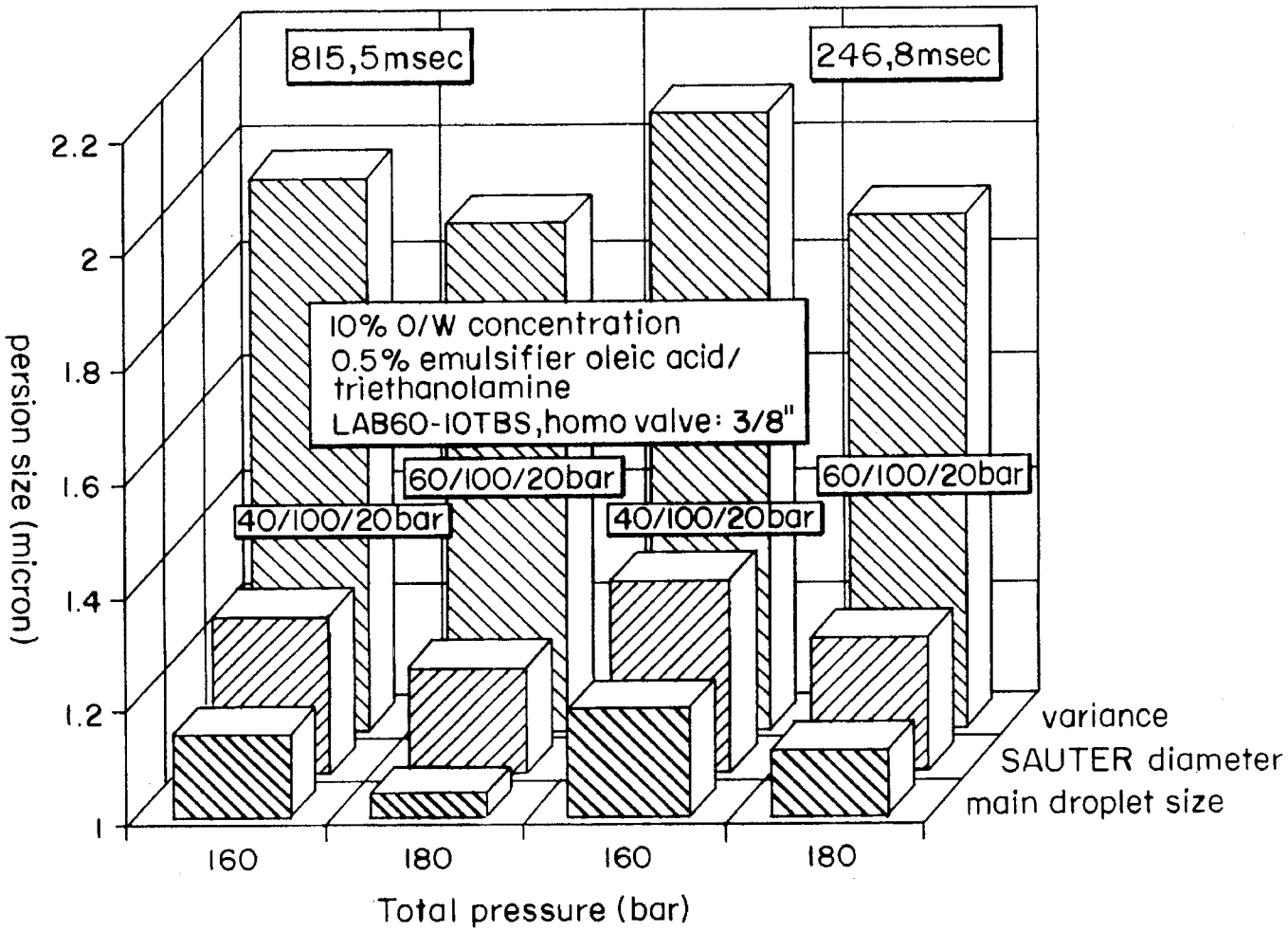
FIG. 7 presents another illustration of the improvement provided by the holding chamber of FIG. 3.

FIG. 7 presents other test results indicating reduced droplet size in the system using the holding chamber.

In addition to the energy savings provided by the present invention, the system results in less maintenance, due to the reduced total pressure and smaller pressure drop per homogenizing stage, and provides a savings by eliminating the cost of separate premix devices located in the feed line to the homogenizer pump.

The following products have been tested with the present invention:

1. 5%/10%/20% o/w emulsion with 1% emulsifier Tween 80;
2. raw milk with 4.2% fat concentration;
3. 10% o/w emulsion with 0.5% (w/w) emulsifier oleic acid/triethanolamine;
4. filled milk 3.5% fat.

Those tests provide the following results.

1. The total pressure can be reduced up to 20%–50% to reach the same results as a 2 stage homogenizer, depending on type of emulsion, emulsifier and how pressure is distributed among the 3 stages.

2. The residence time between two homogenizing steps improves activity of emulsifier to newly generated oil surface. An additional energy reduction of approximately 5% could be found on lab-scale tests.

It is generally expected that the preferred ranges of pressure drops across each of the homogenizing stages are as follows:

First stage 20–200 bar, preferably 20–100 bar.

Second stage 50–1000 bar, preferably 50–700 bar.

Third stage 20–200 bar, preferably 20–70 bar.

The dwell time between the first and second stages is preferably between 0.5 and 5 seconds and most preferably between 0.8 and 2 seconds. This additional dwell time is particularly suited to products with slow emulsifier kinetics.

Further tests and explanation of the present invention can be found in a related Disclosure Document No. 351954 filed in the names of applicants on Apr. 7, 1994.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A homogenizing system comprising:

a liquid pump; and first, second and third stage homogenizing valves connected in series to receive successively liquid from the pump, homogenize the liquid in each of the first, second and third stages and deliver the homogenized product from the third stage to a product output, the pressure drop across the third stage being within the range of 20–200 bar.

2. A homogenizing system as claimed in claim 1 further comprising an extended holding chamber between the first and second stages.

3. A homogenizing system as claimed in claim 1 wherein a dwell time obtained between the first and second stages is in the range of 0.5 to 5 seconds.

4. A homogenizing system as claimed in claim 1 wherein a dwell time obtained between the first and second stages is in the range of 0.8 to 2 seconds.

5. A homogenizing system as claimed in claim 1 wherein the pressure drops across the first, second and third homogenizing valves fall within the ranges of 20–200 bar, 50–1000 bar and 20–200 bar respectively.

6. A homogenizing system as claimed in claim 5 wherein a dwell time obtained between the first and second stages is in the range of 0.5 to 5 seconds.

7. A homogenizing system as claimed in claim 5 wherein a dwell time obtained between the first and second stages is in the range of 0.8 to 2 seconds.

8. A homogenizing system as claimed in claim 1 wherein the pressure drops across the first, second and third homogenizing valves fall within the ranges of 20–100 bar, 50–700 bar and 20–70 bar respectively.

9. A homogenizing system as claimed in claim 8 wherein a dwell time obtained between the first and second stages is in the range of 0.5 to 5 seconds.

10. A homogenizing system as claimed in claim 8 wherein a dwell time obtained between the first and second stages is in the range of 0.8 to 2 seconds.

11. A homogenizing system as claimed in claim 1 wherein an output port of the first stage homogenizing valve provides liquid to an input port of the second stage homogenizing valve and an output port of the second stage homogenizing valve provides liquid to an input port of the third stage homogenizing valve.

12. A method of homogenizing comprising:

pumping liquid through a first stage homogenizing valve;

conducting the liquid from the first homogenizing valve through a second homogenizing valve;

conducting the liquid from the second homogenizing valve through a third homogenizing valve with a pressure drop within the range of 20–200 bar; and delivering the liquid from the third homogenizing valve as a system output.

13. The method of claim 12 further providing an extended dwell time between the first and second homogenizing valves.

14. A method as claimed in claim 13 wherein the dwell time is in the range of 0.5 to 5 seconds.

15. A method as claimed in claim 13 wherein the dwell time is in the range of 0.8 to 2 seconds.

16. A method as claimed in claim 12 wherein the pressure drops across the first, second and third homogenizing valves are in the ranges of 20–200 bar, 50–1000 bar and 20–200 bar respectively.

17. A method as claimed in claim 16 wherein the dwell time is in the range of 0.5 to 5 seconds.

18. A method as claimed in claim 16 wherein the dwell time is in the range of 0.8 to 2 seconds.

19. A method as claimed in claim 12 wherein the pressure drops across the first, second and third homogenizing valves are in the ranges of 20–100 bar, 50–700 bar and 20–70 bar respectively.

20. A method as claimed in claim 19 wherein the dwell time is in the range of 0.5 to 5 seconds.

21. A method as claimed in claim 19 wherein the dwell time is in the range of 0.8 to 2 seconds.

22. A method as claimed in claim 12, further comprising conveying the liquid through an output port of the first stage homogenizing valve to an input port of the second stage homogenizing valve and conveying the liquid from an output port of the second stage homogenizing valve to an input port of the third stage homogenizing valve.

23. A system for homogenization of a pumped fluid, comprising:

a first stage homogenizing valve including a first inlet for receiving the fluid into the system, a first valve seat, and a first valve member, the fluid being expressed between the first valve seat and the first valve member to a first outlet;

a second stage homogenizing valve including a second inlet for receiving the fluid from the first outlet, a second valve seat, and a second valve member, the fluid being expressed between the second valve seat and the second valve member to a second outlet; and a third stage homogenizing valve including a third inlet for receiving the fluid from the second outlet, a third valve seat and a third valve member, the fluid being expressed between the third valve seat and the third valve member to an outlet of the system with a pressure drop within the range of 20–200 bar.

24. A system as claimed in claim 23, further comprising an extended holding chamber between the first outlet of the first stage homogenizing valve and the second inlet of the second stage homogenizing valve.

25. A system as claimed in claim 23, wherein the valve members are resiliently urged against the valve seats.

26. A homogenizing system comprising:

a liquid pump; and first, second, and third stage homogenizing means connected in series to receive successively liquid from the pump, homogenizing liquid in each of the first, second and third stages and delivering the homogenized product from the third stage, with a pressure drop within the range of 20–200 bar, to a product output.

* * * * *